US010814149B2

(12) United States Patent
Liggett et al.

(10) Patent No.: US 10,814,149 B2
(45) Date of Patent: Oct. 27, 2020

(54) REDUNDANT ADJUSTABLE LANYARD

(71) Applicant: JiMi IP, LLC, Allegan, MI (US)

(72) Inventors: James Allen Liggett, Allegan, MI (US); Michael Matthew Kiella, Allegan, MI (US); Ricky James McKinney, Allegan, MI (US); Caitlin Marie McMahan, Allegan, MI (US); Sean Raymond Horihan, Allegan, MI (US)

(73) Assignee: JiMi IP, LLC, Allegan, MI (US)

( * ) Notice: Subject to any disclaimer, the term of this patent is extended or adjusted under 35 U.S.C. 154(b) by 149 days.

(21) Appl. No.: 16/181,126

(22) Filed: Nov. 5, 2018

(65) Prior Publication Data

US 2019/0134438 A1 May 9, 2019

Related U.S. Application Data

(60) Provisional application No. 62/582,436, filed on Nov. 7, 2017.

(51) Int. Cl.
*A62B 35/00* (2006.01)
*A62B 35/04* (2006.01)
(Continued)

(52) U.S. Cl.
CPC ..... *A62B 35/0075* (2013.01); *A62B 35/04* (2013.01); *A47L 3/00* (2013.01); *A47L 3/04* (2013.01)

(58) Field of Classification Search
CPC ..... A62B 35/04; A62B 35/0075; A47L 3/00; A47L 3/04
See application file for complete search history.

(56) References Cited

U.S. PATENT DOCUMENTS 3,444,957 A * 5/1969 Gilpin, Jr. ..... F16F 7/00 182/3
3,592,502 A * 7/1971 Bolliger ..... B66C 1/18 294/74

(Continued)

FOREIGN PATENT DOCUMENTS

DE 102007043577 A1 * 3/2009 ..... A62B 35/0075
GB 2191560 A * 12/1987 ..... A62B 35/04

OTHER PUBLICATIONS

Ropes Courses, Inc., 2010 Product Catalog (published Nov. 1, 2010), 20 pages.

(Continued)

*Primary Examiner* — Colleen M Chavchavadze
(74) *Attorney, Agent, or Firm* — Polson Intellectual Property Law, PC; Margaret Polson; Christopher Sylvain

(57) ABSTRACT

A lanyard for attaching a user's harness to a moveable member of a challenge course. The lanyard may comprise an upper section, a lower section, and a midsection arranged therebetween. The upper section may comprise an upper outer loop and an upper inner loop arranged within the upper outer loop, which form an opening configured to attach to the moveable member, and one or more structural connections. The lower section may comprise a lower outer loop and a plurality of lower inner loops configured to receive a coupling device for the harness. The plurality of lower inner loops may be sequentially arranged within the lower outer loop and attached to the lower outer loop via double shear connections.

20 Claims, 12 Drawing Sheets

(51) Int. Cl.
*A47L 3/04* (2006.01)
*A47L 3/00* (2006.01)

(56) References Cited

U.S. PATENT DOCUMENTS 4,405,034 A * 9/1983 Dunne ..... E06C 1/56 182/100
4,538,702 A * 9/1985 Wolner ..... A62B 35/04 182/230
4,577,726 A * 3/1986 Wheeler ..... B63B 29/205 114/362
5,308,101 A * 5/1994 Monty ..... B60D 1/182 267/74
5,688,011 A * 11/1997 Gulley ..... B66C 1/105 294/74
5,848,667 A * 12/1998 Davidson ..... B63B 27/14 182/190
D418,301 S * 1/2000 Anderson ..... D3/327
6,331,024 B1 * 12/2001 Gulley ..... B66C 1/18 294/74
D454,235 S * 3/2002 Kaplan ..... D30/153
6,357,551 B1 * 3/2002 Bogardus, III ..... E06C 1/56 182/190
6,390,234 B1 * 5/2002 Boyer ..... A62B 35/0018 182/3
7,175,534 B2 2/2007 Liggett
D573,381 S * 7/2008 Pinholster, Jr. ..... D6/387
7,416,054 B2 8/2008 Liggett
7,585,197 B1 * 9/2009 Merten ..... B63B 27/146 182/136
7,650,717 B2 * 1/2010 Drayer ..... A01G 17/10 47/32.5
7,981,004 B2 7/2011 Liggett et al.
8,016,686 B2 9/2011 Liggett et al.
8,066,578 B2 11/2011 Liggett
D661,175 S * 6/2012 Dahl ..... D8/349
8,360,937 B2 1/2013 Liggett
8,505,683 B1 * 8/2013 Dirrig ..... A63B 27/00 182/9
8,683,925 B2 4/2014 Liggett
8,752,668 B2 6/2014 Liggett et al.
8,807,044 B2 8/2014 Liggett et al.
8,893,852 B2 11/2014 Liggett
8,905,451 B1 * 12/2014 Golz ..... A62B 35/0075 119/857
8,944,976 B2 * 2/2015 Crowell ..... A63B 21/0442 482/121
9,150,999 B2 * 10/2015 Dahl ..... D07B 1/18
9,328,436 B2 * 5/2016 Russell ..... D03D 1/0094
9,750,329 B1 * 9/2017 Pinholster, Jr. ..... A45F 3/22
9,782,682 B2 10/2017 Frankowski et al.
9,884,633 B2 2/2018 Horihan
9,907,389 B2 * 3/2018 Conlin ..... D03D 3/08
9,978,242 B2 * 5/2018 Ulner ..... A62B 35/0075
D862,875 S * 10/2019 Liggett ..... D3/215
10,537,758 B2 * 1/2020 Comet ..... A62B 35/04
D876,206 S * 2/2020 Pinholster ..... D8/356
10,604,892 B1 * 3/2020 Caliri ..... D07B 9/00
2006/0027277 A1 * 2/2006 Jennings ..... D03D 11/00 139/408
2008/0060872 A1 * 3/2008 Wise ..... A62B 35/04 182/3
2008/0179136 A1 * 7/2008 Griffith ..... A62B 35/04 182/5
2012/0161376 A1 * 6/2012 Hede ..... A62B 35/0075 267/73
2015/0141205 A1 5/2015 Garland
2016/0272225 A1 9/2016 Liggett et al.
2016/0319492 A1 11/2016 Horihan
2017/0036123 A1 2/2017 Liggett et al.
2017/0173378 A1 6/2017 Garland
2018/0154909 A1 6/2018 Horihan

OTHER PUBLICATIONS

Ropes Courses, Inc., 2012 Product Catalog (published Nov. 1, 2012), 56 pages.
Ropes Courses, Inc., 2014 Product Catalog (published Nov. 1, 2014), 56 pages.
Ropes Courses, Inc., 2015 Product Catalog (published Feb. 1, 2015), 60 pages.
Ropes Courses, Inc., 2016 Product Catalog (published Aug. 1, 2016), 72 pages.
Ropes Courses, Inc., 2017 Product Catalog (published Aug. 1, 2017), 48 pages.
Walltopia, "Product Catalogue" (retrieved Mar. 24, 2017), 104 pages.
Walltopia, "Adventure" Project Guide (retrieved Mar. 24, 2017), 119 pages.
Walltopia, "Ropetopia" Brochure (retrieved Nov. 1, 2017), 8 pages.
Kristallturm, "High Rope Courses" Brochure (retrieved Nov. 1, 2017), 66 pages.

* cited by examiner

REDUNDANT ADJUSTABLE LANYARD

CROSS-REFERENCE TO RELATED APPLICATIONS

This application claims the benefit of U.S. provisional patent application No. 62/582,436, filed Nov. 7, 2017, which is incorporated-by-reference herein for all purposes.

BACKGROUND

The present disclosure relates to a safety tether or lanyard for persons navigating a high ropes course, which is also known as a challenge course. A challenge course generally comprises a structure allowing participants to traverse obstacles at an elevated height for amusement and thrill. Therefore, a fall safety system is an integral part of any challenge course given the risk of serious injury or even death that may result in falling from an elevated height.

A fall safety system generally incorporates a length of flexible material commonly referred to as a lanyard or tether. The lanyard attaches a body harness worn by a user to a moveable member (e.g., a safety hook) securely mounted to a fixed track, cable, or the like. The moveable member is generally configured to slide or roll along the fixed track or cable as the participant navigates obstacles in the challenge course. If a user slips or otherwise loses his or her balance, the lanyard attached to the user's harness will safely catch the user and prevent the user from falling to the ground. The effective lanyard length between a user and the fixed track is usually determined by the person's height and/or the particular aspects of the challenge course. Therefore, lanyards may have various attachment points available for coupling to the harness, in order to achieve an appropriate lanyard length and optimize safety for any given user.

To improve safety in challenge courses, redundant lanyard systems have been developed to mitigate against the risk of component failure. In such configurations, for example, two separate lanyards may be used to connect the user's harness to the moveable member. Therefore, if one lanyard or a component thereof fails during use, the other lanyard provides an additional measure to prevent a free fall situation. However, such redundant lanyard systems have more components and are generally more cumbersome and complicated to use and operate, as compared to a conventional single lanyard configuration. Further, these types of redundant lanyard systems also carry an inherent risk of entanglement, particularly with the highly flexible lanyards commonly used. Entanglement can lead to injured or broken appendages and even strangulation if a user is caught between straps of material under pressure, as may happen during a fall. Further, entanglement can cause unintentional disengagement of the coupling device (e.g., a carabiner) securing the harness to the lanyard. Users also often have a tendency to intentionally wrap flexible lanyards around their hands while navigating a challenge course, which results in the lanyard squeezing their hands or fingers with a substantial amount of force and potentially causing injury if the user sits down or falls and is then caught by the lanyard.

Accordingly, lanyards and lanyard systems sometimes fail to meet the high standards for operational safety, simplicity and/or versatility that are desired in modern challenge courses. Therefore, a need exists for an uncomplicated lanyard system providing an adjustable attachment length and multiple attachment points, as well as improved safety and redundant measures against component failure.

The foregoing examples of the related art and limitations therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be illustrative, not limiting in scope. In various embodiments, one or more of the above described problems have been reduced or eliminated, while other embodiments are directed to other improvements.

The present disclosure relates to a tether or lanyard for use in a challenge course. One aspect of the present disclosure is to mitigate against the risk of component failure by providing redundant safety systems or mechanisms, such that more than one element of the lanyard must be compromised before a catastrophic failure will occur. A further aspect of the present disclosure is to increase the opportunity of challenge course personnel to detect indications of component damage in advance of a catastrophic failure of the lanyard. Another aspect of the present disclosure is to provide multiple points of attachment for objects, such as coupling devices (e.g. carabiners), ropes, equipment bags, and moveable or anchoring members, for example. Another aspect of the present disclosure is to provide a plurality of attachment points for a body harness worn by a user so that the effective length of the lanyard between the user and a moveable member of the challenge course may be adjusted appropriately. Another aspect of the present disclosure is to reduce or eliminate the risk of the lanyard entangling users, objects, and/or clothing. Another aspect of the present disclosure is to introduce sufficient rigidity in the structural configuration of the lanyard to prevent or limit potential injuries caused when flexible material wraps around the neck or appendages of a user in a free fall situation. Another aspect of the present disclosure is to provide a safe and strong lanyard system that can still accommodate the range of movements performed by a user when navigating the obstacles of a challenge course. Further aspects of the present disclosure will become apparent to persons skilled in the art upon review of this specification and the appended drawings.

According to the present disclosure, a lanyard is described for attaching a harness worn by a user to a moveable member of a challenge course. The lanyard may provide component redundancy to improve safety by reducing the risk posed by the failure of a single component; multiple attachment points for making effective lanyard length adjustments if needed and for attaching multiple coupling devices thereon for the duplication of safety mechanisms; as well as a relatively rigid single-piece construction which reduces the risk of entanglement therein. Rigidity also promotes proper alignment of the lanyard with respect to the moveable member and track, and prevents the tendency of users to wrap the lanyard around their hand while traversing the challenge course. The lanyard may comprise an upper section, a lower section, and a midsection arranged between the upper section and the lower section. The sections may be constructed of any suitable semi-flexible material, such as woven nylon or polyester fibers, for example. In some embodiments, there may be at least two layers of material present along the entire, or substantially the entire, longitudinal extent of the lanyard. In other embodiments, there may be at least two layers of material present along at least a majority of the longitudinal extent of the lanyard. The arrangement of two or more adjacent layers of material in certain sections contributes to the rigidity of the lanyard system through such sections.

The upper section may comprise an upper outer loop and an upper inner loop arranged within the upper outer loop. The upper outer loop and the upper inner loop may form a moveable member attachment opening configured to securely receive the moveable member. One or more structural connections may securely join adjacent pieces or layers of the upper section together. At least one structural connection may join sides of the upper outer loop and the upper inner loop together, the sides of the upper outer loop to each other, and/or the sides of the upper inner loop to each other. For example, the structural connection may be a traverse connection extending through and joining all layers of the upper section together at that location. In some embodiments, the upper section has a plurality of structural connections. The connections securely attaching two or more adjacent pieces or layers of the lanyard together may be formed by any coupling of adequate strength for use in a challenge course, such as stitching sewn with thread of sufficient strength properties.

The lower section may comprise a lower outer loop and any number of lower inner loops configured to receive a coupling device for the harness. The plurality of lower inner loops may be sequentially positioned inside the lower outer loop and attached to the lower outer loop via double shear connections. A double shear configuration provides considerable strength for load bearing while the continuous loop of material wrapped around said double shear connections provides redundancy. Each of the plurality of lower inner loops may be formed by a piece of material folded over on itself. The ends of this piece of material may be arranged facing upward within the lower outer loop. A double shear connection may join the ends of each piece of material forming to both sides of the lower outer loop. In some embodiments, the lower outer loop may extend downward past the bottommost lower inner loop sequentially arranged within the lower outer loop, thereby forming an opening or gap between the lower outer loop and said bottommost lower inner loop, which may then be used for attaching additional items thereto.

The upper outer loop and the lower outer loop may be formed from a single piece or length of material. In certain embodiments, the upper inner loop is also formed from the same piece of material as the upper outer loop. In other embodiments, the upper outer loop and the upper inner loop are formed from different pieces of material. The lower inner loops and the lower outer loops may be formed from different pieces of material as well.

In addition to the aspects and embodiments described above, further aspects and embodiments will become apparent by reference to the accompanying drawings and the detailed description forming a part of this specification.

BRIEF DESCRIPTION OF THE DRAWINGS

The present disclosure is further described below with reference to the accompanying figures.

Before further explaining the depicted embodiments, it is to be understood that the invention is not limited in its application to the details of the particular arrangements shown, since the invention is capable of other embodiments. It is intended that the embodiments and figures disclosed herein are to be considered illustrative rather than limiting. Also, the terminology used herein is for the purposes of description and not limitation.

DETAILED DESCRIPTION

Certain terminology is used in this description for convenience and reference only, and should not be considered limiting. For example, the terms "upper," "lower," "outer," and "inner" are used to refer to locations and the placement of features relative to the geometric center of the lanyard and the orientation of intended use. The terms "connected," "attached," "coupled," or similar language includes both directly and indirectly "connected," "attached," and "coupled." This convention not only applies to the terms specifically mentioned, but also to similar, related, and derivative terms and phrases as well. As used herein, the term "structural connection" refers to a load bearing connection between two or more pieces of material having sufficient strength to withstand the forces experienced during use of the lanyard. The term "double shear connection" is used to refer to a structural connection that attaches a lower inner loop to the lower outer loop as described in more detail below.

Figure 1:
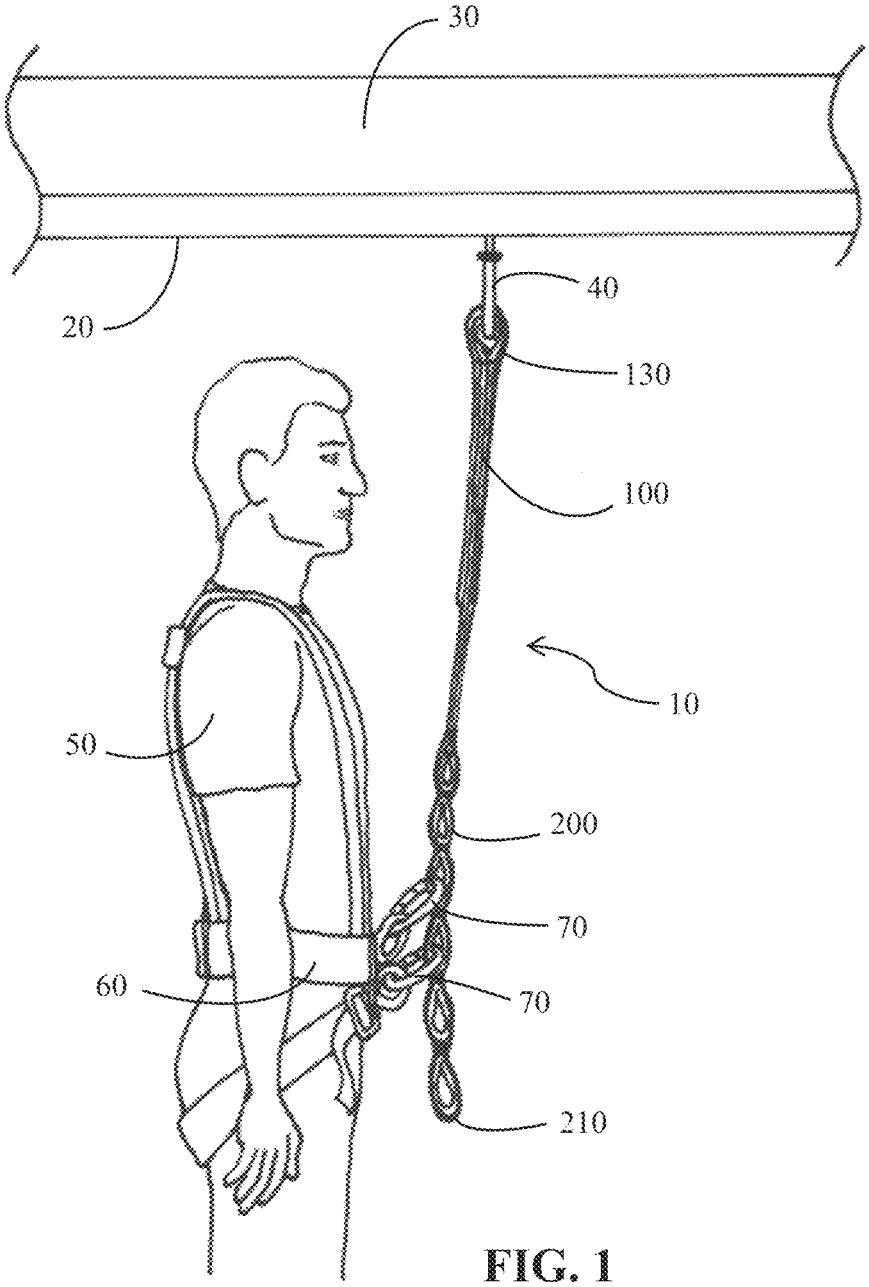
FIG. 1 shows a side view of a lanyard being used in a challenge course according to the present disclosure.

FIG. 1 illustrates a lanyard 10 being used in a challenge course according to the present disclosure. The depicted challenge course setting comprises a track 20 mounted on a support structure 30. A moveable member 40 is secured to the track 20 and configured to slide along the track 20 as a participant or user 50 navigates and progresses through the challenge course. As in the depicted embodiment, the track 20 may have a shell construction forming an inner channel with a slot opening running the base of the track 20, wherein the head of the moveable member 40 is secured within the inner channel and the body of the moveable member 40 extends downward through the slot opening for attachment to the lanyard 10. However, other configurations of the track 20 and moveable member 40 are possible as well. For example, the track 20 could comprise a fixed cable structure, in which case the moveable member 40 may be provided as a hooked device coupled to the fixed cable structure and configured to slide along the same. It should further be appreciated that ropes or other obstacles would be present throughout the challenge course (not shown). Reference is made to U.S. Pat. No. 7,175,534 disclosing a challenge course structure for more information and context regarding challenge courses, if desired.

The user 50 wears a safety harness 60 which is attached to the lanyard 10 via a coupling device 70. The coupling device 70 may comprise any suitable connector, such as a carabiner, for example. For redundancy in the case of component failure, two coupling devices 70 may be used to attach the lanyard 10 to the harness 60 as shown in the depicted embodiment. However, it should be appreciated that the lanyard 10 accordingly to the present disclosure may be attached to the harness 60 with only one coupling device 70 if desired, or more than two coupling devices 70 depending on the design of the harness 60 and the availability of attachment points thereto.

Figure 2:
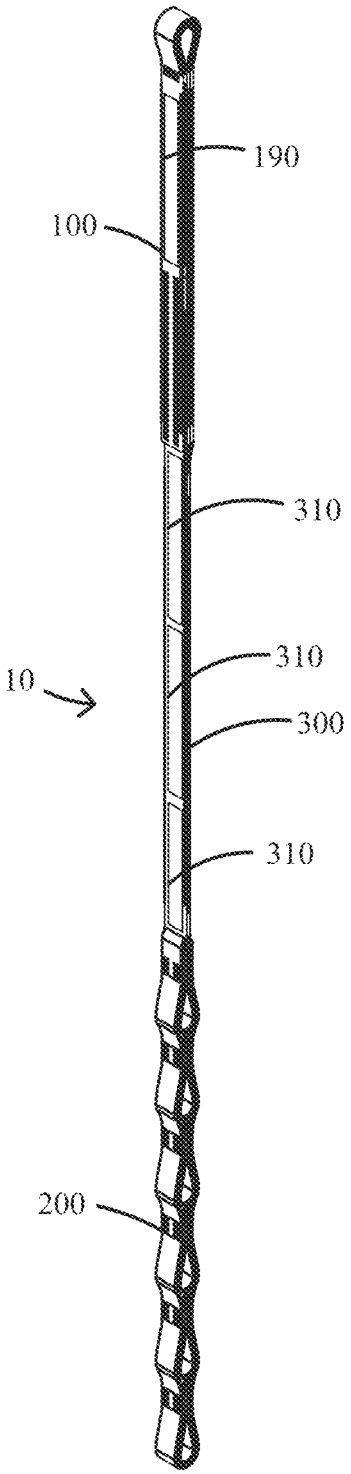
FIG. 2 shows a perspective view of a lanyard according to the present disclosure.

As seen in FIG. 2, an embodiment of the lanyard 10 according to the present disclosure may comprise an upper section 100, a lower section 200, and a midsection 300. The lanyard 10 and sections or components thereof may be constructed of, but not limited to, a woven webbing-type material such as nylon or polyester fibers, for example. Of course, other materials may be used having sufficient levels of strength, flexibility and workability for application in a challenge course according to the present disclosure.

Figure 3:
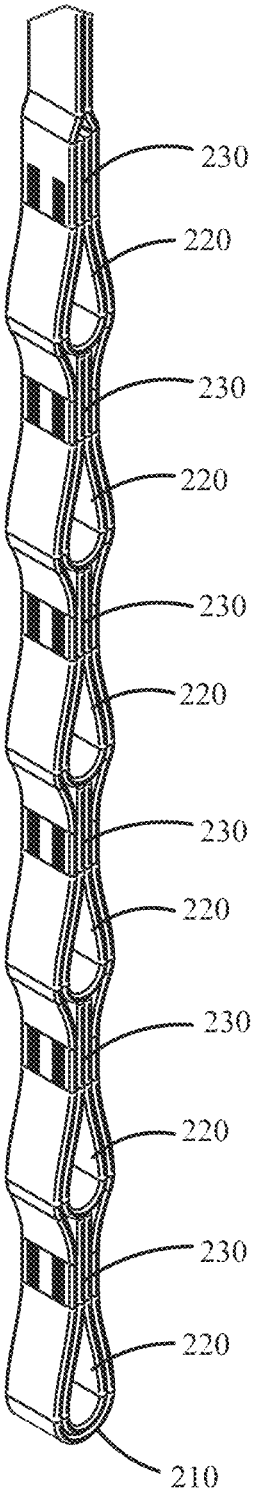
FIG. 3 shows an enlarged view of the lower section of the lanyard of FIG. 2.

FIG. 3 shows an enlarged view of the lower section 200 of the lanyard 10 of FIG. 2. The lower section 200 of the lanyard 10 comprises a lower outer loop 210 and a plurality of lower inner loops 220 sequentially arranged within the lower outer loop 210. The lower outer loop 210 may be formed of a continuous length or strap of material folded over to wrap around the plurality of lower inner loops 220, the ends of the lower outer loop 210 extending upward to form the midsection 300 of the lanyard 10.

Each lower inner loop 220 is configured to receive a coupling device 70 for attachment of the lanyard 10 to the harness 60. In this way, the lower inner loops 220 provide a variety of locations on the lanyard 10 to securely attach to the harness 60 via one or more coupling devices 70. Each lower inner loop 220 may be formed from a single length or strap of material folded over, the looped material being of adequate size to receive a coupling device 70, whereby the ends of the lower inner loop 220 face upward in the direction of the next higher lower inner loop 220 positioned inside the lower outer loop 210 (or the midsection 300 in the case of the topmost lower inner loop 220). The exact number and spacing of the lower inner loops 220 may be determined by the degree of adjustability desired in attaching one or more coupling devices 70 to the lower section 200 of the lanyard 10. The openings formed by the lower inner loops 220 configured to receive a coupling device 70 may be sized large enough to be able to easily slide a coupling device 70 (e.g., a carabiner) therethrough, but also small enough that a user would not be able to insert his or her hand through said openings (which could result in injury or the user's hand becoming stuck therein).

Each lower inner loop 220 may attach to both sides of the lower outer loop 210 via a double shear connection 230. The double shear connections 230 may be formed by stitching sewn using thread of adequate strength for example. Of course, any other suitable securement means may be used to attach the lower inner loops 220 to the lower outer loop 210 within the scope of the present disclosure. Each double shear connection 230 transverses through the four layers of material provided by the lower outer loop 210 and the lower inner loop 220. In this way, the double shear connection 230 may distribute a load from a lower inner loop 220 to both sides of the lower outer loop 210. The double shear connections 230 are represented by solid bars in the embodiment of FIG. 3.

The described combination of the lower outer loop 210 and the lower inner loop(s) 220 effectively creates a redundant construction improving the safety of the lanyard 10, whereas more than one layer of material must fail before a coupling device 70 attached to a harness 60 worn by a user 50 (seen in FIG. 1) can be allowed to exit the lanyard 10. For instance, if the bottommost lower inner loop 220 fails, a coupling device 70 arranged therein would still need to break through the lower outer loop 210. Likewise, even if the bottom portion of the lower outer loop 210 were compromised, the lower inner loop 220 holding the coupling device 70 would still need to fail before the coupling device 70 could exit the lanyard 10. Moreover, the sequential arrangement of the lower inner loops 220 means that each lower inner loop 220 (except the bottommost lower inner loop 220) is further supported and protected against failure by the lower inner loop(s) 220 positioned thereunder. It should also be appreciated that a plurality of lower inner loops 220 offers the use of multiple coupling devices 70 for attachment to multiple points on the body harness 60, thereby further increasing the ability to employ component redundancy to provide alternate safety mechanisms in the event of failure. Further, the multilayered structural configuration of the lower section 200 in the depicted embodiment also provides rigidity to the lower section 200, thereby reducing the risk of entanglement, promoting proper alignment of the lanyard 10, and preventing users from being able to wrap the lower section 200 around their hands.

Figure 4:
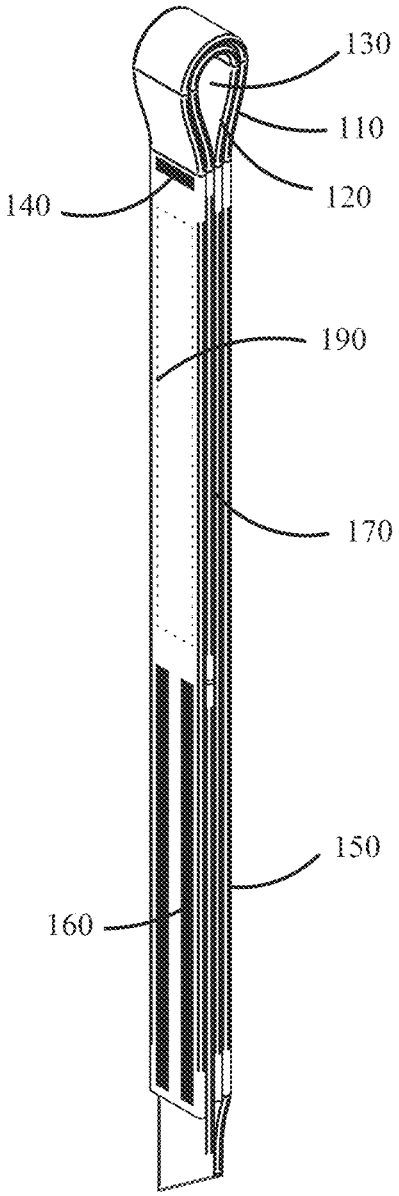
FIG. 4 shows an enlarged view of the upper section of the lanyard of FIG. 2.

FIG. 4 shows an enlarged view of the upper section 100 of the lanyard 10 of FIG. 2. The upper section 100 of the lanyard 10 comprises an upper outer loop 110 and an upper inner loop 120. The upper outer loop 110 and the upper inner loop 120 form a moveable member attachment opening 130 for attachment of the lanyard 10 to the moveable member 40. Although direct attachment to the moveable member 40 is described herein, it should be appreciated that a separate coupling device (not shown) may instead be secured within the moveable member attachment opening 130 to securely link the lanyard 10 to the moveable member 40. The combination of the upper outer loop 110 and the upper inner loop 120 effectively creates a redundant construction improving the safety of the lanyard 10, whereas more than one layer of material must fail before a moveable member 40 (seen in FIG. 1) or a moveable member coupling device, as the case may be, can be allowed to exit the lanyard 10. For instance, if the upper outer loop 110 were to fail, a moveable member 40 arranged in the moveable member attachment opening 130 would still need to break through the upper inner loop 120. Likewise, if the upper inner loop 120 were compromised, the upper outer loop 110 would still need to fail before the moveable member 40 could exit the moveable member attachment opening 130 of the lanyard 10. Therefore, even if one were to completely cut a single piece of material of the upper section 100 at any location not comprising a structural connection to another piece of material, there will still be a load bearing support pathway formed by a closed loop of material with structural connection to the lower section 200. Further, the multilayered structural configuration of the upper section 100 (and connections therebetween) in the depicted embodiment also provides rigidity to the upper section 100, thereby reducing the risk of entanglement, promoting proper alignment of the lanyard 10, and preventing users from being able to wrap the upper section 100 around their hands.

As in the depicted embodiment of FIG. 4, a captive connection 140 may be provided below the moveable member attachment opening 130 for the closure of said moveable member attachment opening 130. The captive connection 140 may connect all fours layers of material provided by the upper outer loop 110 and the upper inner loop 120 at this location. As with the double shear connections 230, the captive connection 140 may be a strong stitch sewn using thread of adequate strength, but any other suitable securement means may be used within the scope of the present disclosure. The captive connection 140 may be used to provide stiffness and a tight closure of the moveable member attachment opening 130 for connection to the moveable member 40 (or moveable member coupling device). In this way, the captive connection 140 can ensure that the lanyard 10 is tightly attached to the moveable member 40, thereby preventing the lanyard 10 from acting as a hinge at this location and keeping a proper alignment of the lanyard 10 and moveable member 40 with respect to the track 10 as a user maneuvers through the challenge course, particularly when traveling around corners or otherwise changing direction. Further, a loose connection between the moveable member 40 and the moveable member attachment opening 130 could allow the moveable member 40 to potentially become misaligned and stuck within the track 10. In certain embodiments, the captive connection 140 may also be a structural connection of sufficient strength to safely withstand the forces exerted during use of the lanyard by a user navigating a challenge course.

The upper outer loop 110 may be formed of a continuous length or strap of material folded over to wrap around the upper inner loop 120. In certain embodiments (see FIGS. 5-8), the upper outer loop 110 and the upper inner loop 120 are formed by separate pieces of material. For example, one side of the midsection 300 may extend upward to form the upper outer loop 110 encompassing the separate upper outer loop 120 therein. In such cases, the upper outer loop 110, the lower outer loop 210, and the midsection 300 may all be formed by the same length of material. In still other embodiments (see FIGS. 9-12), the upper outer loop 110 and the upper inner loop 120 are formed by the same piece of material. For example, one side of the midsection 300 may extend upward to form the upper outer loop 110 while the other side of the midsection 300 may extend upward to form the upper inner loop 120 encompassed by the upper outer loop 110. In such cases, the upper outer loop 110, the upper inner loop 120, the lower outer loop 210, and the midsection 300 may all be formed by the same length of material. For the sake of clarity, separate pieces of adjacent material are provided with different hatching in the schematic diagrams of FIGS. 5-13; it being understood that these pieces may or may not be constructed of the same actual material (e.g., nylon or polyester fibers).

The upper section 100 of the lanyard 10 further comprises at least one structural connection. The structural connections of the upper section 100 may formed by a strong stitch sewn using thread of adequate strength, although any other suitable securement means for application in a challenge course may be used as well within the scope of the present disclosure. In the embodiment of FIG. 4, the upper section 100 comprises: an outer-to-inner loop structural connection 150 that couples one side or layer of the upper outer loop 110 to one side or layer of the upper inner loop 120 (see also FIGS. 5, 7, 9 and 11) thereby providing structural integrity between the upper outer loop 110 and the upper inner loop 120; an outer-to-outer loop structural connection 160 that couples one side or layer of the upper outer loop 110 to the other side or layer (see also FIGS. 5 and 7) thereby securing the material of the upper outer loop 110 back onto itself and thus forming a loop to receive the moveable member 40; and an inner-to-inner loop structural connection 170 that couples one side or layer of the upper inner loop 120 to the other side or layer (see also FIGS. 5, 6, 9 and 10) thereby securing the material of the upper inner loop 120 back onto itself and thus forming a loop to receive the moveable member 40. The structural connections 150, 160, 170 are represented by solid bars in FIG. 4. In other embodiments, the at least one structural connection 150 may comprise one or more traverse structural connections 180 (see FIGS. 6-8 and 10-12). Said traverse structural connections 180 extend through and securely join all four layers of the upper section 100 together. In this way, one or more traverse structural connections 180 may be used instead of, or in addition to, the outer-to-inner loop structural connection 150, the outer-to-outer loop structural connection 160, and/or the inner-to-inner loop structural connection 170.

As shown in FIG. 4, the upper section 100 may also comprise one or more non-structural connections 190 for holding layers of material together. In this embodiment, the non-structural connection 190 couples a side of the upper outer loop 110 to a side of the upper inner loop 120. But the non-structural connection is otherwise not acting as a load-bearing connection here, which is being provided by the outer-to-inner loop structural connection 150. In this way, adjacent layers of the upper outer loop 100 and the upper inner loop 120 are prevented from coming apart during use and pinching or entangling objects, users, and/or clothing. Coupling material layers in this manner also reduces the complexity of the lanyard which promotes a more user-friendly assembly. As with other connections of the lanyard 10, the one or more non-structural connections 190 may be formed by stitching or any other suitable securement means. The non-structural connection 190 is represented by a broken line in the embodiment of FIG. 4.

Turning back to FIG. 2, the midsection 300 is arranged between the upper section 100 and the lower section 200 of the lanyard 10. The midsection 300 may extend upward to form at least the upper outer loop 110 of the upper section 100 (see FIGS. 5-8). Additionally, the midsection 300 may also extend upward to form the upper inner loop 120 of the upper section 100 (see FIGS. 9-12). In the opposite direction, the midsection 300 may extend downward to form the lower outer loop 210 of the lower section 200 (see FIGS. 5-12). The dimensional length of the midsection 300 may be selected to accommodate different user height ranges and/or the structural configuration of a particular challenge course and obstacles thereof. For example, the midsection 300 may be relatively longer if that particular lanyard 10 is designated for use by children or shorter individuals. In some embodiments, the extent of the midsection 300 may be entirely or substantially limited to the transition between the upper section 100 (comprising the upper outer loop 110, the upper inner loop 120, and connections therefor) and the lower section 200 (comprising the lower outer loop 210, at least one lower inner loop 220, and connections therefor). If minimized enough, a "midsection" may even be considered to have been omitted for all practical purposes and still fall within the scope and spirit of the present disclosure. In other cases, the extent of the midsection may be considerably longer than depicted, if desired for a specific application, for example.

As seen in the embodiment of FIG. 2, the midsection 300 may be provided with one or more non-structural connections 310 to couple the sides of the midsection 300 together. In this way, the sides of the midsection 300 are prevented from coming apart during use and pinching or entangling objects, users, and/or clothing. Coupling material layers in this manner also reduces the complexity of the lanyard which promotes a more user-friendly assembly. As with other connections of the lanyard 10, the one or more non-structural connections 310 may be formed by stitching or any other suitable securement means. Since only two layers of strap material may be present in the midsection 300, and because the connections 310 of the midsection 300 may only function to keep the two layers of strap material secured together (i.e. form non-load bearing connections), the midsection 300 may provide the lanyard 10 with a considerable amount of flexibility and rotational capacity, particularly in comparison to the relatively more rigid upper section 100 and lower section 200. Although previously known lanyards often suffered from excessive flexibility—thereby increasing the risk of entanglement and component failure—some degree of flexibility is advantageous so that the lanyard can adequately accommodate the various physical movements performed by users in navigating a challenge course without restriction. Therefore, a lanyard 10 according to the present disclosure may combine relatively rigid sections 100, 200 with a comparatively more flexible or semi-flexible midsection 300 to provide for both structural integrity and freedom of motion. At the same time, however, the double-layered configuration of the midsection 300 in the depicted embodiment also provides some degree of rigidity and stiffness thereto, thereby reducing the risk of entanglement, promoting proper alignment of the lanyard 10, and preventing users from being able to wrap the midsection 300 around their hands.

FIGS. 5-12 show schematic side view representations of various embodiments of a lanyard 10 according to the present disclosure. In these figures, different hatch lines are used to clearly depict and differentiate separate pieces of material of the lanyard 10 from one another. The lanyard 10 and components thereof may be constructed from a woven webbing-type material, such as nylon or polyester fibers, although any other suitable material for application in a challenge course may be used as well within the scope of the present disclosure. Moreover, bolded boxes are used in the figures to identify the location of structural connections 150, 160, 170, 180, 230 that bond two or more adjacent pieces of material together. The structural connections 150, 160, 170, 180, 230 may comprise a strong stitch sewn using thread of adequate strength for load bearing, although any other suitable securement means for application in a challenge course may be used as well within the scope of the present disclosure.

The embodiments of FIGS. 5-12 share the same configuration for the lower section 200 and the midsection 300 of the lanyard 10. The midsection 300 provides the transition between the upper section 100 and the lower section 200. The lower section 200 comprises a lower outer loop 210 and a plurality of lower inner loops 220 configured to receive a coupling device 70 for attachment to a harness 60 worn by a user 50 (see FIG. 1). The plurality of lower inner loops 220 are sequentially arranged within the interior of the lower outer loop 210. The plurality of lower inner loops 220 and the lower outer loop 210 may be formed from separate pieces or straps of material. The lower outer loop 210 may be formed by a continuous length or strap of material extending from the midsection 300 and wrapping around any number of lower inner loop(s) 220. Each lower inner loop 220 may comprise a strap of material folded over to form the opening of the lower inner loop 220 for receiving the coupling device 70 therein. The openings of the lower inner loops 220 configured to receive a coupling device 70 may be sized large enough to be able to easily slide a coupling device 70 (e.g., a carabiner) therethrough, but also small enough that a user would not be able to insert his or her hand through said openings 220 (which could result in injury or the user's hand becoming stuck therein). In the depicted embodiments here, the ends of the strap or length of material forming a lower inner loop 220 face upward within the lower outer loop 210 in the direction of the midsection 300. A double shear connection 230 joins the ends of the length or strap of material of each lower inner loop 220 to each side of the lower outer loop 210. The double shear connections 310 may distribute a load from the lower inner loops 220 to both sides of the lower outer loop 210. In this way, the plurality of lower inner loops 220 of the lower section 200 provide multiple attachment points for coupling devices 70, thereby improving safety by allowing for the use of multiple coupling devices 70 and by allowing the lanyard 10 to be adjusted to a particular user and/or challenge course. Further, the combination of the lower inner loops 220 and the lower outer loop 210 protects against the conventional risk of failure of either component by effectively creating a redundant safety system, since more than one layer of material must fail before a coupling device 70 can exit the lanyard 10. And even if one layer of material were compromised, such redundancy allows challenge course personnel an opportunity to detect indications of complete or partial component failure upon routine inspection and use, in advance of a catastrophic lanyard failure, given the unlikelihood that both the lower outer loop 210 and a lower inner loop 220 would fail in an immediate and simultaneous manner.

In the embodiments of FIGS. 5-12, the upper section 100 of the lanyard 10 comprises an upper outer loop 110 and an upper inner loop 120 arranged within the upper outer loop 110, whereby the loops 110, 120 form a moveable member attachment opening 130 for coupling the lanyard 10 to a moveable member 40 mounted to a track 20 of a challenge course (see FIG. 1). In this way, the combination of the upper outer loop 110 and the upper inner loop 120 protects against the conventional risk of failure of either component by effectively creating a redundant safety system, since more than one layer of material must fail before a moveable member 40 positioned within the moveable member attachment opening 130 can exit the lanyard 10. And even if one layer of material were compromised, such redundancy allows challenge course personnel an opportunity to detect indications of complete or partial component failure upon routine inspection and use, in advance of a catastrophic lanyard failure, given the unlikelihood that both the upper outer loop 110 and the upper inner loop 120 would fail in an immediate and simultaneous manner. As discussed above, a captive connection 140 (see FIG. 4) may be provided underneath the closure of the moveable member attachment opening 130 to secure the same. In the depicted embodiments here, the upper outer loop 110 is formed by one side of the midsection 300 extending upward to wrap around the upper inner loop 120 and then continuing downward to couple to the other side of the midsection 300 (which extends upward to form a layer of the upper section 100) thereby completing the upper outer loop 110. These embodiments further illustrate various structural configurations for the upper section 100, which are described in turn. In the depicted structural configurations, even if one were to completely cut a single piece of material of the upper section 100 at any location not comprising a structural connection to another piece of material, there will still be a load bearing support pathway formed by a closed loop of material with structural connection to the lower section 200.

In the embodiments of FIGS. 5-8, the upper outer loop 110 and the upper inner loop 120 are formed from separate pieces or lengths of material. The upper outer loop 110 is formed by the same piece of material that forms the midsection 300 and the lower outer loop 210 of the lower section 200. On the other hand, the upper inner loop 120 is formed by a separate piece of material arranged in between the layers of the upper outer loop 110. At least one structural connection is provided to securely attach two or more adjacent layers of the upper section 100 to each other.

Figure 5:
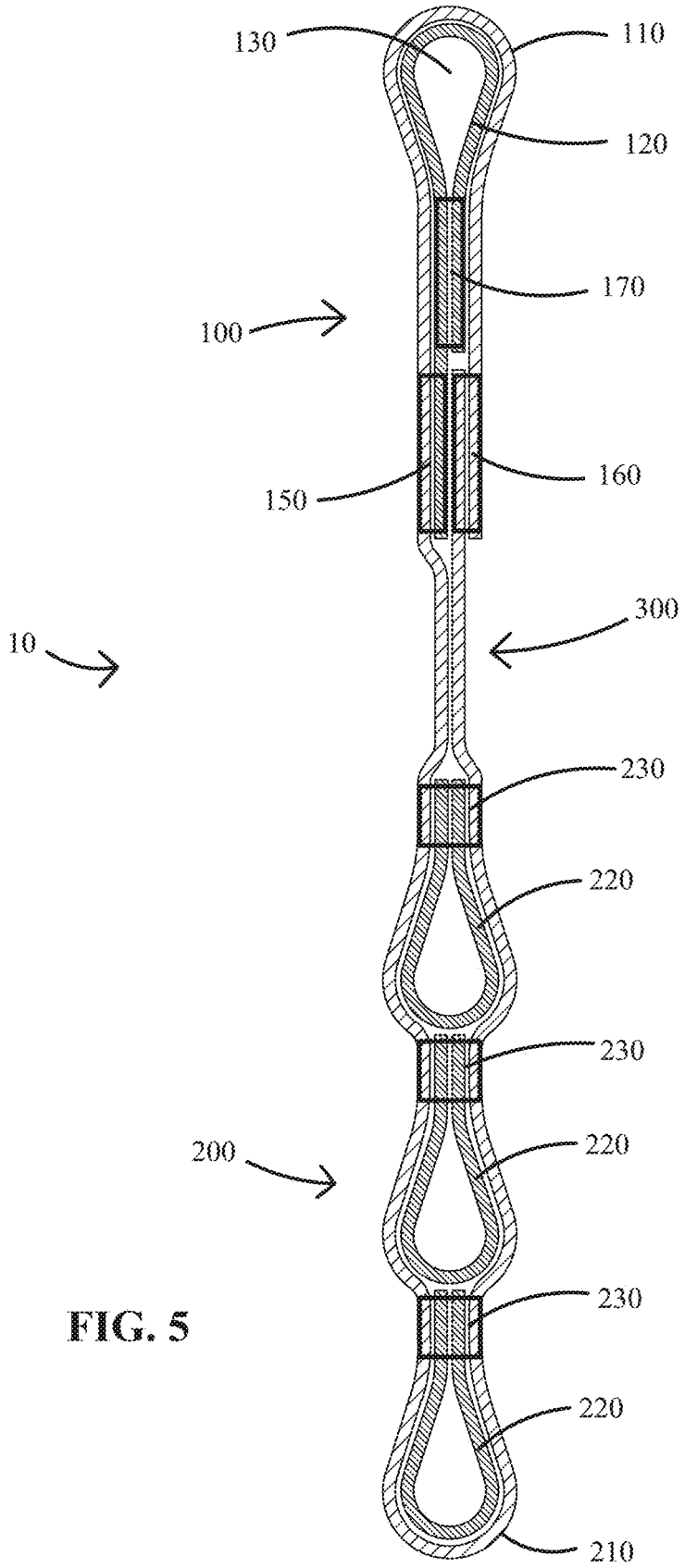
FIG. 5 is a schematic representation of a first embodiment of a lanyard according to the present disclosure viewed from the side.

In the example of FIG. 5, the outer-to-inner loop structural connection 150 joins a single layer of the upper outer loop 110 to a single layer of the upper inner loop 120; the outer-to-outer loop structural connection 160 joins two layers of the upper outer loop 110 together; and the inner-to-inner loop structural connection 170 joins the two layers of the upper inner loop 120 together.

Figure 6:
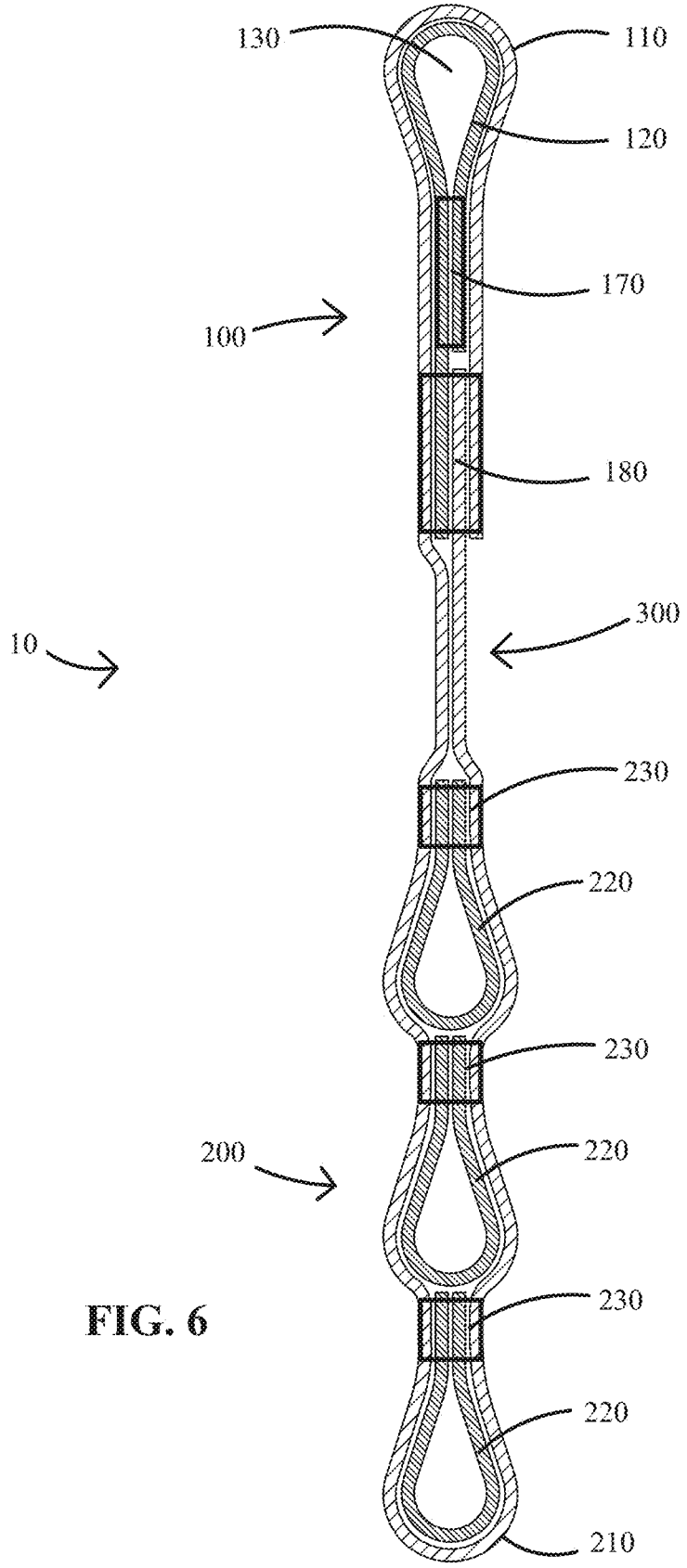
FIG. 6 is a schematic representation of a second embodiment of a lanyard according to the present disclosure viewed from the side.

In the example of FIG. 6, the inner-to-inner loop structural connection 170 joins the two layers of the upper inner loop 120 together; and the traverse structural connection 180 extends through all four layers of the upper section 100 joining three layers of the upper outer loop 110 and a single layer of the upper inner loop 120 together.

Figure 7:
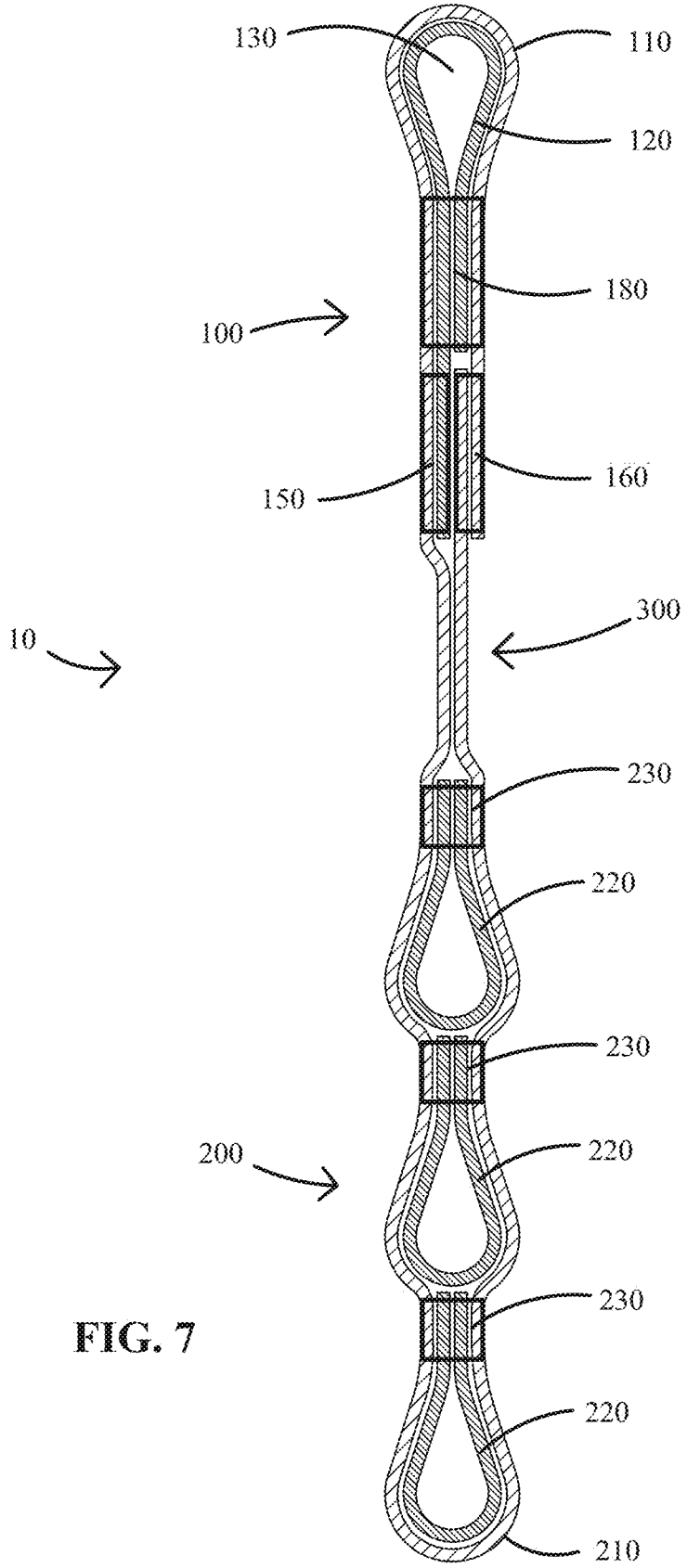
FIG. 7 is a schematic representation of a third embodiment of a lanyard according to the present disclosure viewed from the side.

In the example of FIG. 7, the outer-to-inner loop structural connection 150 joins a single layer of the upper outer loop 110 to a single layer of the upper inner loop 120; the outer-to-outer loop structural connection 160 joins two layers of the upper outer loop 110 together; and the traverse structural connection 180 extends through all four layers of the upper section 100 joining two layers of the upper outer loop 110 and two layers of the upper inner loop 120 together.

Figure 8:
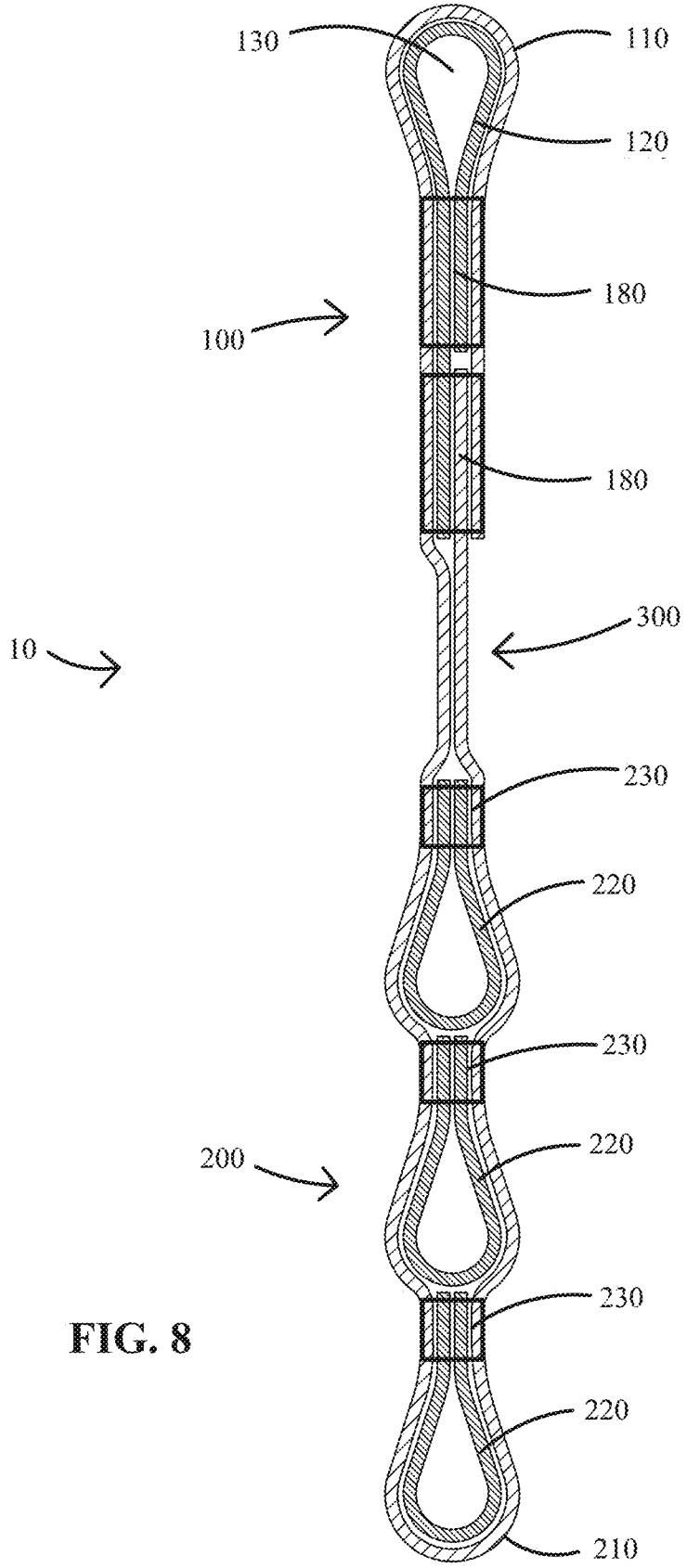
FIG. 8 is a schematic representation of a fourth embodiment of a lanyard according to the present disclosure viewed from the side.

In the example of FIG. 8, the upper traverse structural connection 180 extends through all four layers of the upper section 100 joining two layers of the upper outer loop 110 and two layers of the upper inner loop 120 together; and the lower traverse structural connection 180 extends through all four layers of the upper section 100 joining three layers of the upper outer loop 110 and a single layer of the upper inner loop 120 together.

In the embodiments of FIGS. 9-12, the upper outer loop 110 and the upper inner loop 120 are formed from the same piece or length of material, which also forms the midsection 300 and the lower outer loop 210 of the lower section 200. In these embodiments, one side of the midsection 300 extends upward and folds over onto itself to form the upper inner loop 120, while the other side of the midsection extends upward and wraps around the upper inner loop 120 to form the upper outer loop 110. At least one structural connection is provided to securely attach two or more adjacent layers of the upper section 100 to each other.

Figure 9:
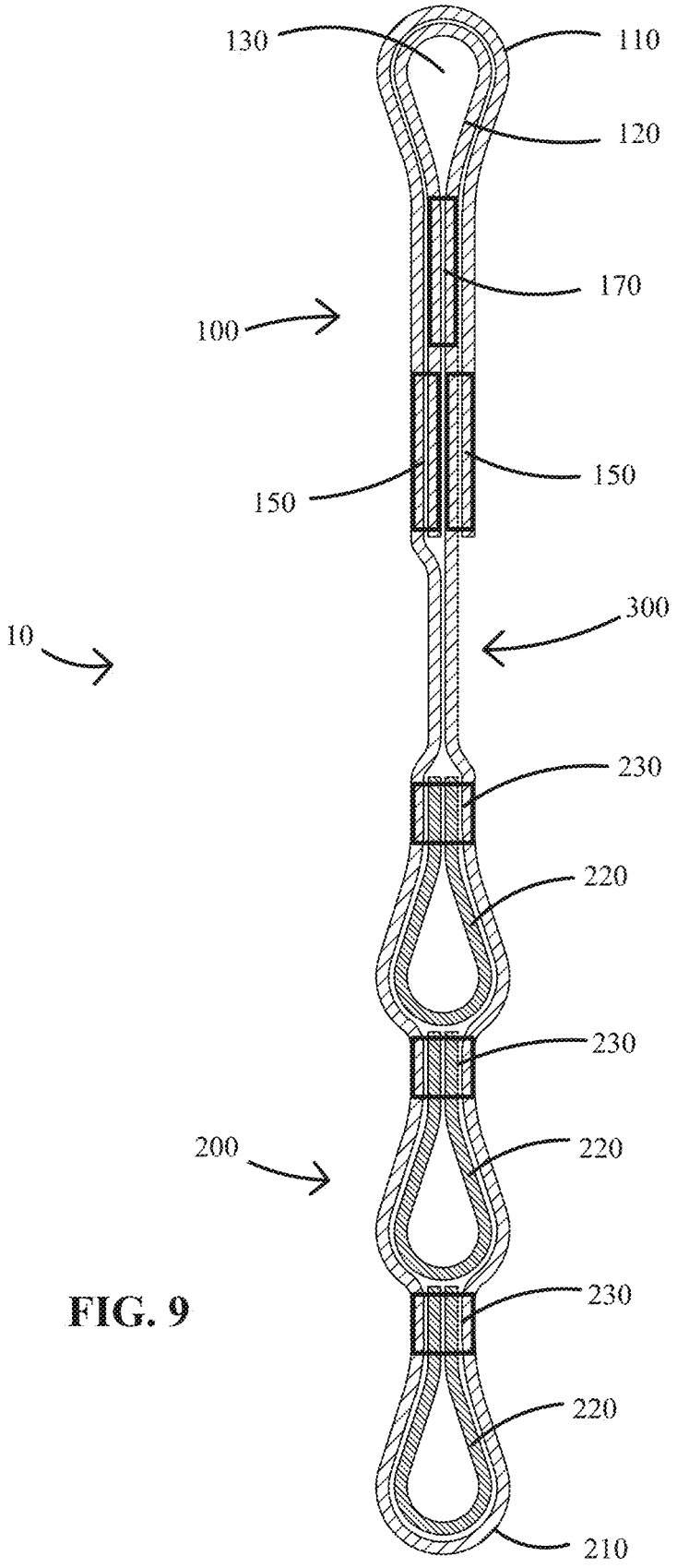
FIG. 9 is a schematic representation of a fifth embodiment of a lanyard according to the present disclosure viewed from the side.

In the example of FIG. 9, the two outer-to-inner loop structural connections 150 each join one layer of the upper outer loop 110 to one layer of the upper inner loop 120; and the inner-to-inner loop structural connection 170 joins the two layers of the upper inner loop 120 together.

Figure 10:
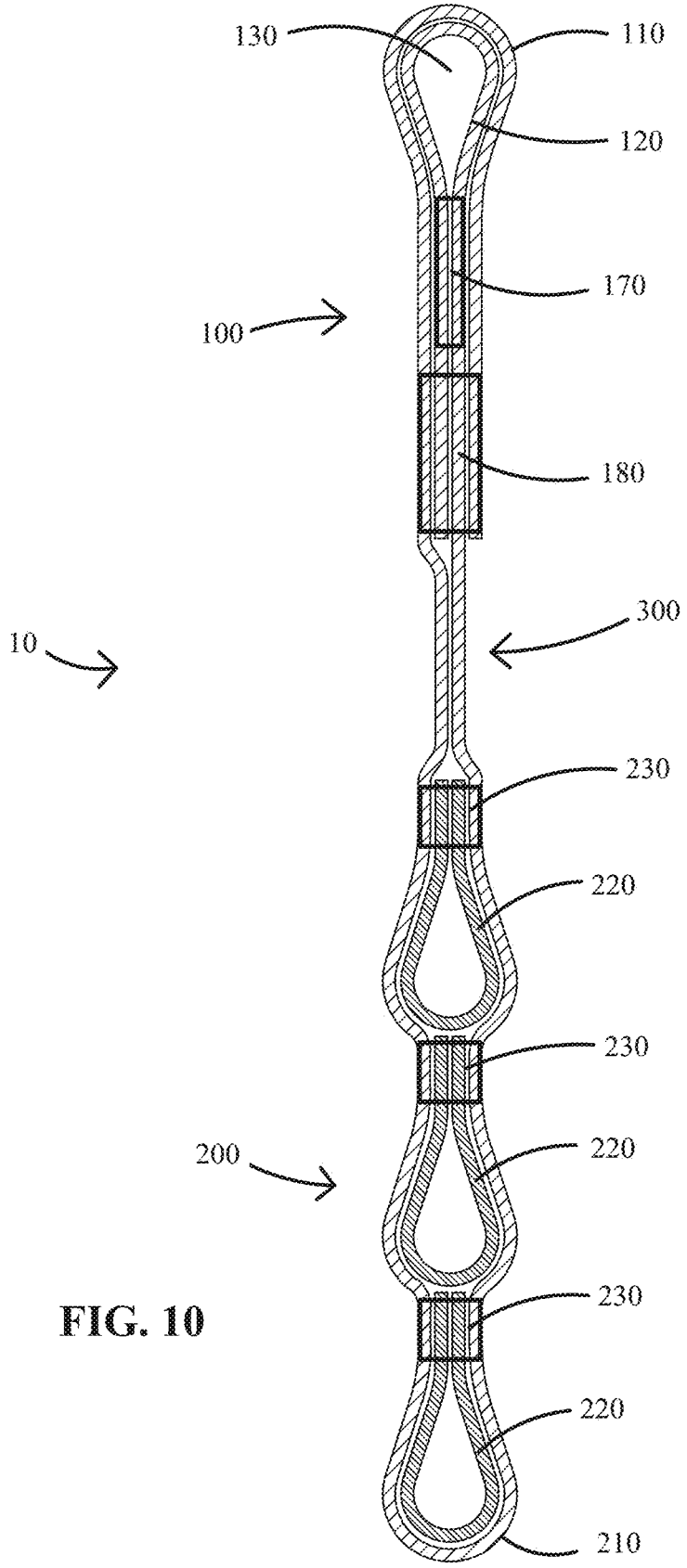
FIG. 10 is a schematic representation of a sixth embodiment of a lanyard according to the present disclosure viewed from the side.

In the example of FIG. 10, the inner-to-inner loop structural connection 170 joins the two layers of the upper inner loop 120 together; and the traverse structural connection 180 extends through all four layers of the upper section 100 joining the two layers of the upper outer loop 110 and the two layers of the upper inner loop 120 together.

Figure 11:
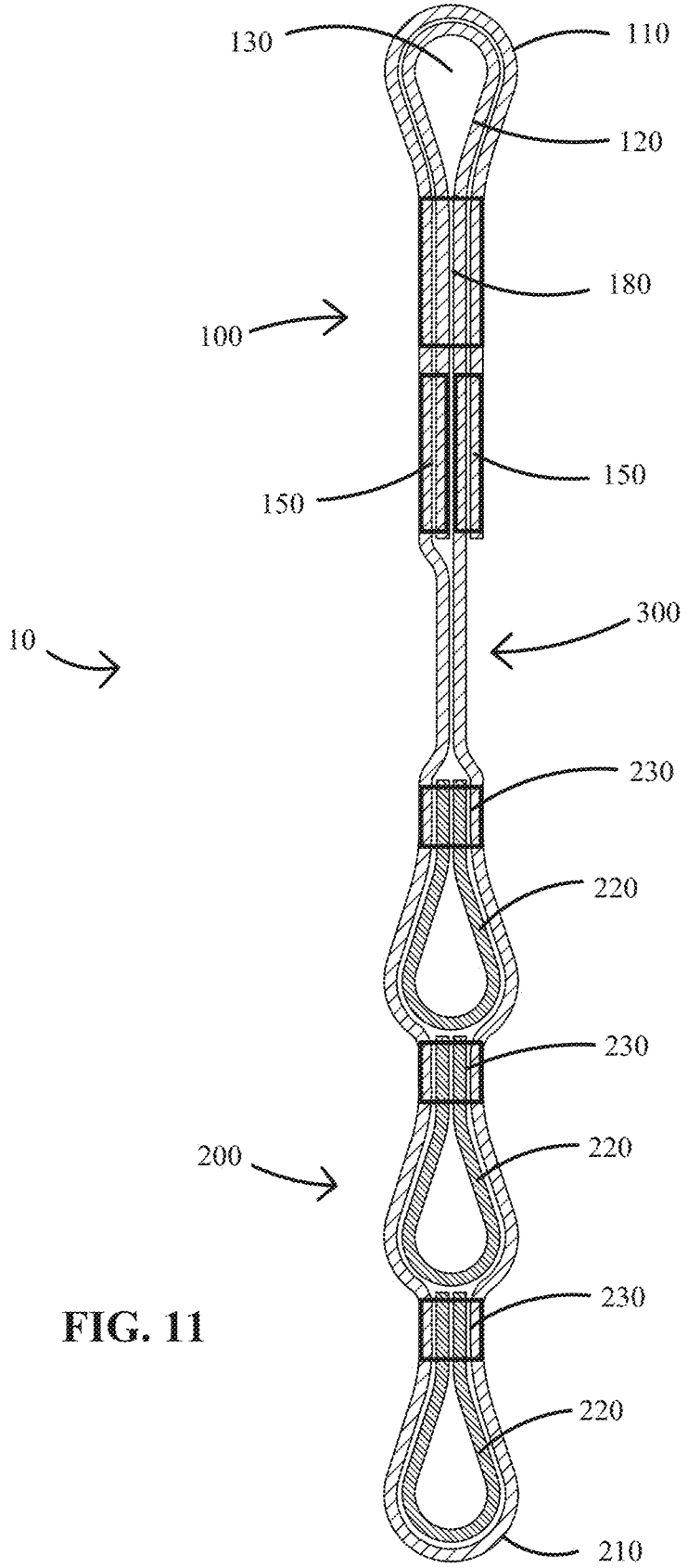
FIG. 11 is a schematic representation of a seventh embodiment of a lanyard according to the present disclosure viewed from the side.

In the example of FIG. 11, the two outer-to-inner loop structural connections 150 each join one layer of the upper outer loop 110 to one layer of the upper inner loop 120; and the traverse structural connection 180 extends through all four layers of the upper section 100 joining the two layers of the upper outer loop 110 and the two layers of the upper inner loop 120 together.

Figure 12:
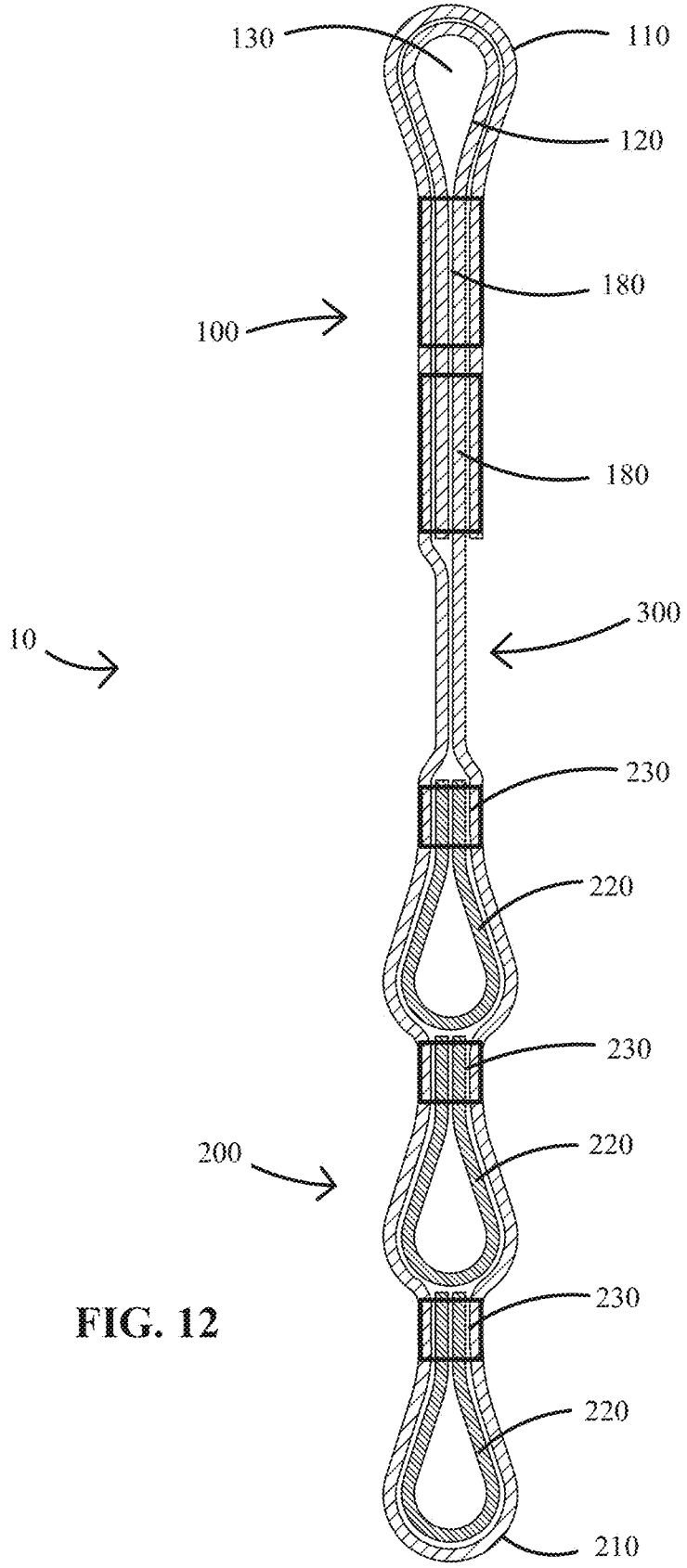
FIG. 12 is a schematic representation of an eighth embodiment of a lanyard according to the present disclosure viewed from the side.

In the example of FIG. 12, the two traverse structural connections 180 extend through all four layers of the upper section 100 and join the two layers of the upper outer loop 110 and the two layers of the upper inner loop 120 together.

Figure 13:
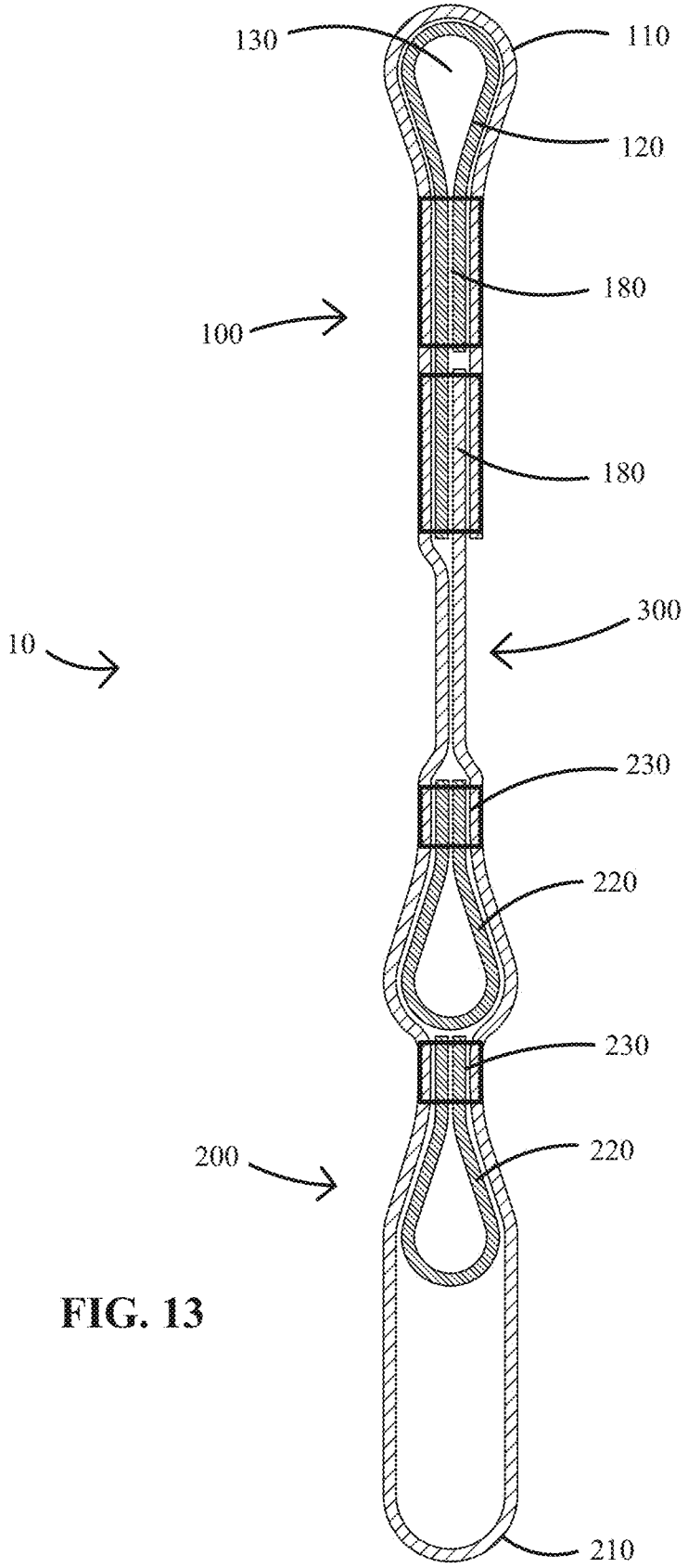
FIG. 13 is a schematic representation of a further embodiment of a lanyard according to the present disclosure viewed from the side.

Referring now to FIG. 13, another embodiment of a lanyard 10 according to the present disclosure is shown with a variation in the lower outer loop 210. In this embodiment, the bottommost lower inner loop 220 has been removed and/or the lower outer loop 210 has been increased in dimension, thereby forming a significant gap between the lower outer loop 210 and the bottommost lower inner loop 220 which may be used to attach one or more additional objects thereto, if desired. For example, ropes, bags, and other equipment that are not adequately sized for attachment to the lower inner loops 220 may instead be securely coupled to the comparatively larger length or extension of the lower outer loop 210 forming the depicted opening underneath the lowest inner loop 220. Otherwise, the lanyard 10 of FIG. 13 is substantially the same as that of FIG. 8.

Figure 14:
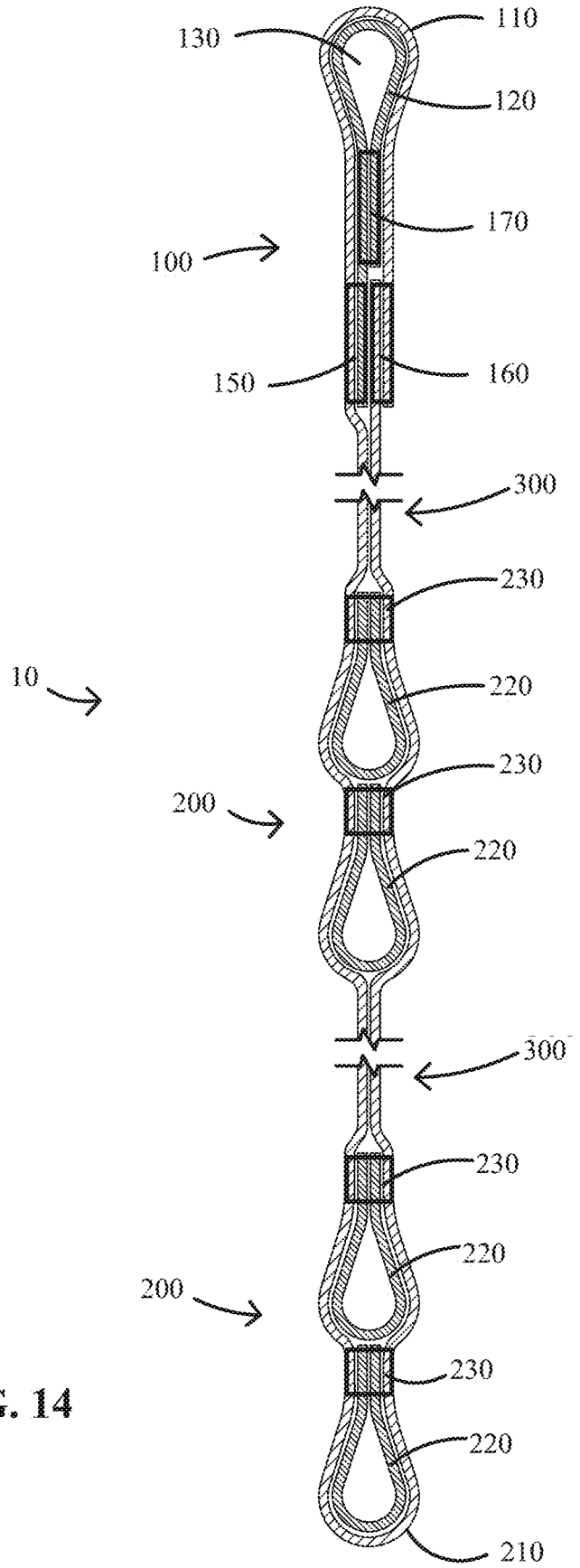
FIG. 14 is a schematic representation of another embodiment of a lanyard according to the present disclosure viewed from the side.

FIG. 14 shows yet another embodiment of a lanyard according to the present disclosure depicted having two midsections 300 and two lower sections 200. The upper section 100 is the same as the upper section 100 of the embodiment depicted in FIG. 4. This embodiment demonstrates that the plurality of lower inner loops 220 may be separated by one or more lengths of material of the lanyard 10 constructed in the manner of the midsection 300 discussed above (e.g., transition areas formed of two layers of material) and still fall within the scope and spirit of the present disclosure. For example, the lower inner loops 220 may be separated by more than one midsection 300 (not shown) depending on the desired application of use. Further, each lower inner loop 220 may be separated from an adjacent lower inner loop 220 by a midsection 300 (not shown) depending on the desired application of use. Still further, the one or more midsections 300 separating the lower inner loops 220 may be of any suitable length (represented by indeterminate length symbols in FIG. 14) depending on the desired application of use.

In FIG. 14, the midsection 300 connecting the upper section 100 to the uppermost lower section 200 is represented having an indeterminate length symbol to show that this midsection 300 may be of any desirable length depending on the intended application of use. It should be appreciated that the midsections 300 of the embodiments depicted by the preceding figures may also be of any desirable length depending on the intended application of use, even though the indeterminate length symbol was not included in those figures. For example, if the distance between the track and obstacles of a particular challenge course requires a longer or shorter lanyard, the length of the midsection(s) of the lanyard may be adjusted accordingly for use with that specific challenge course. Therefore, no limitation is intended or should be inferred by the inclusion of the indeterminate length symbol in FIG. 14 but not in the remaining figures.

In some embodiments, the lanyard 10 may have at least two layers of material present for at least 50% of the length of the lanyard 10 along the longitudinal axis of the lanyard 10. In further embodiments, the at least two layers of material are present for at least 55% of the length of the lanyard 10 along the longitudinal axis of the lanyard 10. In further embodiments, the at least two layers of material are present for at least 60% of the length of the lanyard 10 along the longitudinal axis of the lanyard 10. In further embodiments, the at least two layers of material are present for at least 65% of the length of the lanyard 10 along the longitudinal axis of the lanyard 10. In further embodiments, the at least two layers of material are present for at least 70% of the length of the lanyard 10 along the longitudinal axis of the lanyard 10. In further embodiments, the at least two layers of material are present for at least 75% of the length of the lanyard 10 along the longitudinal axis of the lanyard 10. In further embodiments, the at least two layers of material are present for at least 80% of the length of the lanyard 10 along the longitudinal axis of the lanyard 10. In further embodiments, the at least two layers of material are present for at least 85% of the length of the lanyard 10 along the longitudinal axis of the lanyard 10. In further embodiments, the at least two layers of material are present for at least 90% of the length of the lanyard 10 along the longitudinal axis of the lanyard 10. In further embodiments, the at least two layers of material are present for at least 95% of the length of the lanyard 10 along the longitudinal axis of the lanyard 10. In yet another embodiment, the at least two layers of material are present for substantially the entire length of the lanyard 10 along the longitudinal axis of the lanyard 10.

In some embodiments, the lanyard 10 may have at least four layers of material present for at least 25% of the length of the lanyard 10 along the longitudinal axis of the lanyard 10. In further embodiments, the at least four layers of material are present for at least 30% of the length of the lanyard 10 along the longitudinal axis of the lanyard 10. In further embodiments, the at least four layers of material are present for at least 35% of the length of the lanyard 10 along the longitudinal axis of the lanyard 10. In further embodiments, the at least four layers of material are present for at least 40% of the length of the lanyard 10 along the longitudinal axis of the lanyard 10. In further embodiments, the at least four layers of material are present for at least 45% of the length of the lanyard 10 along the longitudinal axis of the lanyard 10. In further embodiments, the at least four layers of material are present for at least 50% of the length of the lanyard 10 along the longitudinal axis of the lanyard 10. In further embodiments, the at least four layers of material are present for at least 55% of the length of the lanyard 10 along the longitudinal axis of the lanyard 10. In further embodiments, the at least four layers of material are present for at least 60% of the length of the lanyard 10 along the longitudinal axis of the lanyard 10. In further embodiments, the at least four layers of material are present for at least 65% of the length of the lanyard 10 along the longitudinal axis of the lanyard 10. In further embodiments, the at least four layers of material are present for at least 70% of the length of the lanyard 10 along the longitudinal axis of the lanyard 10. In further embodiments, the at least four layers of material are present for at least 75% of the length of the lanyard 10 along the longitudinal axis of the lanyard 10. In further embodiments, the at least four layers of material are present for at least 80% of the length of the lanyard 10 along the longitudinal axis of the lanyard 10. In further embodiments, the at least four layers of material are present for at least 85% of the length of the lanyard 10 along the longitudinal axis of the lanyard 10. In further embodiments, the at least four layers of material are present for at least 90% of the length of the lanyard 10 along the longitudinal axis of the lanyard 10. In further embodiments, the at least four layers of material are present for at least 95% of the length of the lanyard 10 along the longitudinal axis of the lanyard 10. In yet another embodiment, the at least four layers of material are present for substantially the entire length of the lanyard 10 along the longitudinal axis of the lanyard 10.

While a number of aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations, which are within their true spirit and scope. Each embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and sub-combinations possible of the group are intended to be individually included in the disclosure.

In general, the terms and phrases used herein have their art-recognized meaning, which can be found by reference to standard texts, journal references and contexts known to those skilled in the art. The above definitions are provided to clarify their specific use in the context of the invention.

REFERENCE NUMERALS LIST

10 lanyard
20 track
30 support structure
40 moveable member
50 user
60 harness
70 coupling device
100 upper section
110 upper outer loop
120 upper inner loop
130 moveable member attachment opening
140 captive connection
150 outer-to-inner loop structural connection

160 outer-to-outer loop structural connection
170 inner-to-inner loop structural connection
180 traverse structural connection
190 non-structural connection
200 lower section
210 lower outer loop
220 lower inner loop
230 double shear connection
300 midsection
310 non-structural connection

The invention claimed is:

1. A lanyard for attaching a harness worn by a user to a moveable member mounted within a challenge course, the lanyard comprising:

an upper section having an upper outer loop, an upper inner loop, and a moveable member attachment opening, the moveable member attachment opening formed by the upper outer loop and the upper inner loop, the upper inner loop arranged within the upper outer loop, the upper section comprising one or more structural connections joining the upper outer loop and the upper inner loop together; and a lower section having a lower outer loop and a plurality of lower inner loops configured to receive a harness coupling device, the plurality of lower inner loops sequentially arranged within the lower outer loop, each of the plurality of lower inner loops being attached to the lower outer loop via a double shear connection;

wherein the upper outer loop has an exterior surface and an interior surface, the upper inner loop has an exterior surface and an interior surface, and the exterior surface of the upper inner loop faces the interior surface of the upper outer loop;

wherein the lower outer loop has an exterior surface and an interior surface, each of the plurality of lower inner loops has an exterior surface and an interior surface, and the exterior surface of each of the plurality of lower inner loops faces the interior surface of the lower outer loop.

2. The lanyard of claim 1, further comprising a midsection arranged between the upper section and the lower section, the midsection having at least two layers of material.

3. The lanyard of claim 2, wherein a single piece of material forms at least the upper outer loop, the lower outer loop, and the midsection.

4. The lanyard of claim 3, wherein the single piece of material further forms the upper inner loop.

5. The lanyard of claim 1, wherein a single piece of material forms at least the upper outer loop and the lower outer loop.

6. The lanyard of claim 5, wherein the single piece of material further forms the upper inner loop.

7. The lanyard of claim 1, wherein a single piece of material forms the upper outer loop and the upper inner loop.

8. The lanyard of claim 1, wherein the upper outer loop and the upper inner loop are formed from different pieces of material.

9. The lanyard of claim 1, wherein the lower outer loop and the plurality of lower inner loops are formed from different pieces of material.

10. The lanyard of claim 9, wherein each of the plurality of lower inner loops is formed by a piece of material folded over to form a loop, with ends of said piece of material facing upward within the lower outer loop, and the double shear connection joins the ends of said piece of material to the lower outer loop.

11. The lanyard of claim 1, wherein the upper section comprises a plurality of structural connections, a plurality of layers of material provided by the upper outer loop, and a plurality of layers of material provided by the upper inner loop below the movable member attachment opening.

12. The lanyard of claim 11, wherein at least one of the plurality of structural connections joins layers of the upper outer loop together.

13. The lanyard of claim 11, wherein at least one of the plurality of structural connections joins layers of the upper inner loop together.

14. The lanyard of claim 11, wherein at least one of the plurality of structural connections joins all layers of material comprising the upper section together.

15. The lanyard of claim 1, wherein the one or more structural connections of the upper section comprise stitching.

16. The lanyard of claim 1, wherein the double shear connections of the lower section comprise stitching.

17. The lanyard of claim 1, further comprising a captive connection joining the upper outer loop and the upper inner loop underneath the moveable member attachment opening.

18. The lanyard of claim 17, wherein the captive connection comprises stitching.

19. The lanyard of claim 1, wherein the lower outer loop extends downward past a bottommost lower inner loop of the plurality of lower inner loops sequentially arranged within the lower outer loop, thereby forming a gap between the lower outer loop and the bottommost lower inner loop.

20. The lanyard of claim 1, wherein the upper section and the lower section are made from woven nylon or polyester fibers.

* * * * *